US007311218B2

(12) United States Patent
Varadarajan

(10) Patent No.: US 7,311,218 B2
(45) Date of Patent: Dec. 25, 2007

(54) TAMPER EVIDENT CLOSURE WITH RECLOSE FEATURE

(75) Inventor: Krishnaraju Varadarajan, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 659 days.

(21) Appl. No.: 10/842,873

(22) Filed: May 11, 2004

(65) Prior Publication Data

US 2005/0252916 A1 Nov. 17, 2005

(51) Int. Cl.

| | |
|---|---|
| ***B65D 17/40*** | (2006.01) |
| ***B65D 51/20*** | (2006.01) |
| ***B65D 43/03*** | (2006.01) |
| ***B65D 6/30*** | (2006.01) |
| ***B65D 21/036*** | (2006.01) |

(52) U.S. Cl. ..... 220/257.1; 220/266; 220/270; 220/276; 220/380; 220/619; 206/508

(58) Field of Classification Search ..... 220/258.1, 220/359.1, 359.2, 308, 641–643, 648, 258.3, 220/319, 640, 651, 618–620, 254.1, 276, 220/257.1, 270, 256.1, 619, 257.2, 258.2, 220/615, 258.5; 206/508; 215/274; 229/125.34
See application file for complete search history.

(56) References Cited

U.S. PATENT DOCUMENTS

| | | | | |
|---|---|---|---|---|
| 2,887,244 A | | 5/1959 | Betner | |
| 3,624,789 A | | 11/1971 | Peyser | |
| 4,111,329 A | * | 9/1978 | Lampman | 220/266 |
| 4,154,360 A | | 5/1979 | Smith | |
| 4,328,905 A | * | 5/1982 | Hardt | 220/258.2 |
| 4,682,706 A | | 7/1987 | DeVore et al. | |
| 4,724,979 A | | 2/1988 | Cleevely et al. | |
| 4,856,674 A | | 8/1989 | Berney | |
| 5,020,686 A | | 6/1991 | Dutt | |
| 5,042,680 A | * | 8/1991 | Argudo et al. | 220/276 |
| 5,069,355 A | * | 12/1991 | Matuszak | 220/270 |
| 5,273,176 A | | 12/1993 | Diaz | |
| 5,348,183 A | | 9/1994 | Luch et al. | |

(Continued)

OTHER PUBLICATIONS http://www.brasilata.com.br/in/index_in.php.?Id=Pro12A Brasilata S/A Emb. Metálicas, PLOC Off (Dry Food Products), May 11, 2004.

(Continued)

*Primary Examiner*—Robin A. Hylton
(74) *Attorney, Agent, or Firm*—Alston & Bird LLP

(57) ABSTRACT

There is provided a re-closable closure for a container, wherein the re-closable closure includes a tamper-evident band that provides a stacking surface and stacking step for the stacking of another container and that provides clearance for a membrane lid to seal the opening of the container. The tamper-evident band is connected to a central portion of the closure by a frangible connecting member. The tamper-evident band engages a top edge of the container to connect the closure to the container. After the band has been removed from the central portion and the membrane lid has been removed from the container, the central portion may be connected to the container to re-close the opening of the container. The central portion includes a plug portion that fits into the opening to reseal the container after the initial opening of the container.

13 Claims, 7 Drawing Sheets

U.S. PATENT DOCUMENTS

| | | | | |
|---|---|---|---|---|
| 5,692,635 | A * | 12/1997 | Farrell et al. | 220/270 |
| 5,758,793 | A | 6/1998 | Forsyth et al. | |
| 5,979,690 | A * | 11/1999 | Hartley | 220/266 |
| 6,220,471 | B1 | 4/2001 | Lowry | |
| 6,360,908 | B1 * | 3/2002 | Kline | 220/257.1 |

OTHER PUBLICATIONS http://www.brasilata.com.br/in/index_in.php?Id=Pro12B Brasilata S/A Emb. Metálicas, PLOC Off (Dry Food Products), May 11, 2004.
http://www.brasilata.com.br/in/index_in.php?Id=Not_58 Brasilata S/A Emb. Metalicas, News, May 11, 2004.

* cited by examiner

TAMPER EVIDENT CLOSURE WITH RECLOSE FEATURE

BACKGROUND OF THE INVENTION

1. Field of the Invention

The present invention is related to closures for containers, and more particularly, to re-closable closures that include a tamper-evident band.

2. Description of Related Art

Containers that store perishable goods, such as food products, often include resealable closures so that after the container is first opened, any remaining product can be resealed inside the container to provide a protective barrier against the ingress of oxygen, moisture, contaminants, and other undesirable matter. In addition, closures may include tamper-evident devices to indicate to a consumer whether the closure has been removed or whether the quality of the product inside the container has been otherwise compromised. U.S. Pat. No. 4,682,706 to DeVore et al., discloses such a tamper-evident band.

An alternative tamper-evident band is disclosed in the Ploc Off closure system available from Brasilata S.A. Embalagens Metalicas of Sao Paulo, Brazil. The closure of the Ploc Off closure system includes a central portion that has a plug portion that is inserted into an opening of the container to initially seal the container. A tamper-evident band is connected to an outer periphery of the central portion and is connected to the container so that the tamper-evident band must be at least partially removed from the central portion before a consumer can access the product. Because the closure of the Ploc Off system consists of a polymer material that is believed to be incapable of attaining high-barrier performance against oxygen and/or moisture, the stored product may be inadequately protected from oxygen and/or moisture over an extended period of time. Therefore, a need exists for a tamper-evident closure that provides oxygen and moisture barrier properties prior to the first time the product within the container is accessed.

In addition, the closure of the Ploc Off system further defines a generally planar top surface along the central portion and the tamper-evident band upon which another container may be stacked. However, the stacked containers having the Ploc Off system may inadvertently experience lateral forces that would cause the stacked containers to move laterally relative to the supporting container, thus resulting in the stacked container falling. Therefore, a need also exists for a tamper-evident closure that facilitates stacking of two or more containers to prevent relative lateral movement of the stacked containers.

BRIEF SUMMARY OF THE INVENTION

The invention addresses the above needs and achieves other advantages by providing a re-closable closure that includes a tamper-evident band. The closure provides enough clearance under a central portion of the closure for a membrane lid to seal an opening of the container until the membrane lid is removed to provide initial access to the product in the container. After the membrane lid has been removed during the initial opening of the container, the container may be re-closed by fitting a plug portion on a bottom surface of the central portion into the opening of the container. In addition, the re-closable closure provides a stacking surface for another container to be stacked on the closure and a stacking step that prevents lateral movement of the stacked container.

In one embodiment of the present invention, the re-closable closure includes a generally annular tamper-evident band that engages the top edge of the container to which it is attached to substantially prevent disengagement of the band from the top edge without severing the band. The re-closable closure also includes a central portion that is surrounded by the tamper-evident band. The central portion has an outer periphery connected to the band by a frangible connecting member that must be broken for the band to be removed from the central portion. A plug portion extends downward from a bottom surface of the central portion, and the plug portion is configured to fit into the opening of the container to seal the container. The tamper-evident band defines a stacking surface on an upper surface of the band, and the stacking surface is parallel to and offset below a top surface of the central portion so that the closure defines the stacking step.

A further embodiment of the present invention includes a container with the re-closable closure described above. The container has a container body with a body wall defining a top edge encircling an opening of the container body. An annular ring is affixed to the container body and has an annular portion spaced below the top edge of the body wall and extending radially inwardly from the body wall to define a radially inner edge surrounding a central opening of the ring. A membrane lid is sealed to an upper surface of the annular portion of the ring. Advantageously, the membrane lid comprises a metal foil. The central portion of the closure is spaced above the membrane lid as long as the tamper-evident band remains connected to the central portion. After the band has been removed and the membrane lid removed, the plug portion of the central portion is fitted into the central opening to re-close the container.

Still further embodiments of the re-closable closure and container are included in the present invention. Accordingly, the present invention provides a tamper-evident closure that is usable with a membrane lid for initially sealing a container. In addition, the tamper-evident closure of the present invention facilitates stacking of two or more containers to prevent relative lateral movement of the stacked containers.

BRIEF DESCRIPTION OF THE SEVERAL VIEWS OF THE DRAWINGS

Figure 1:
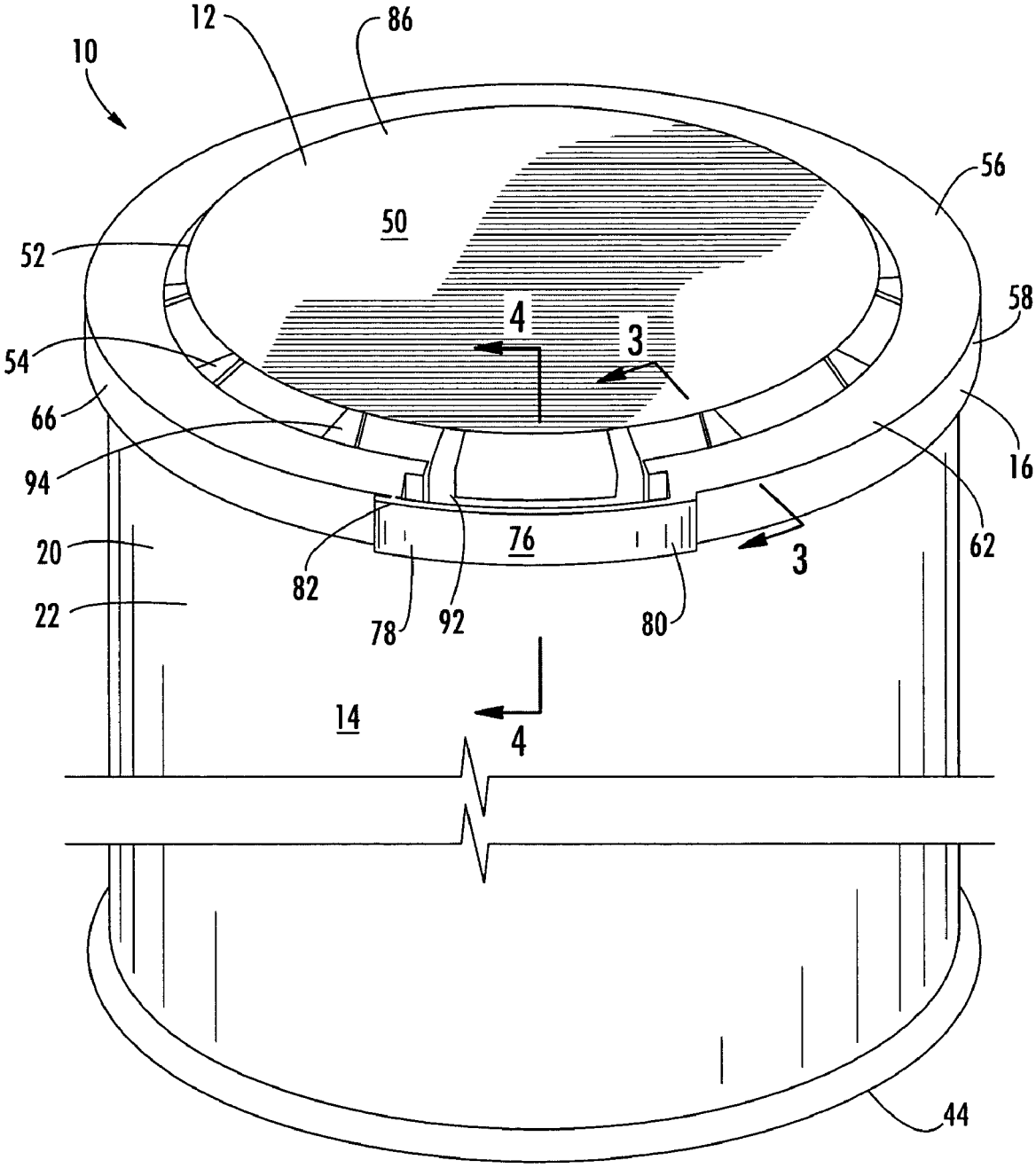
Figure 2:
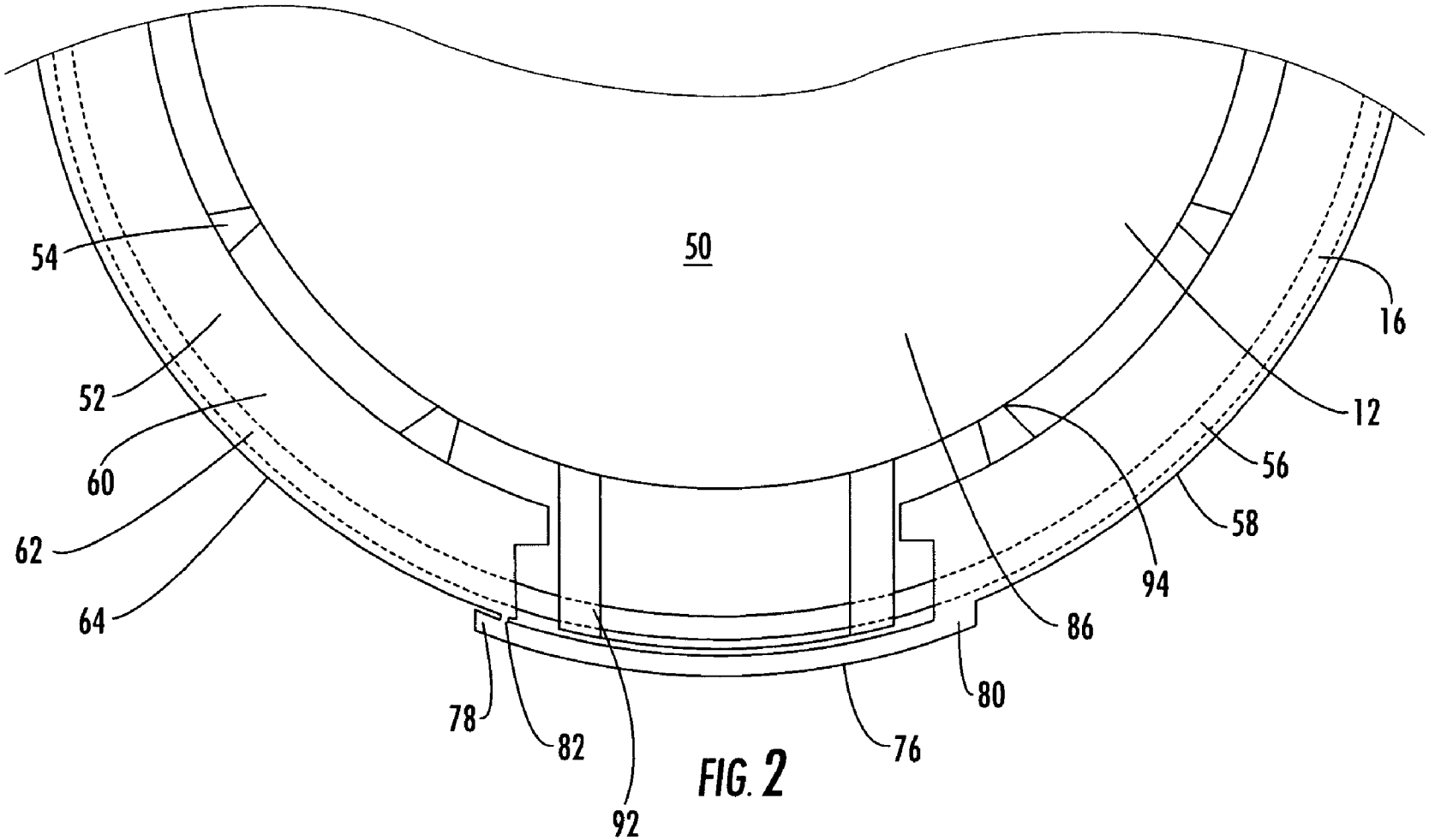
Figure 3:
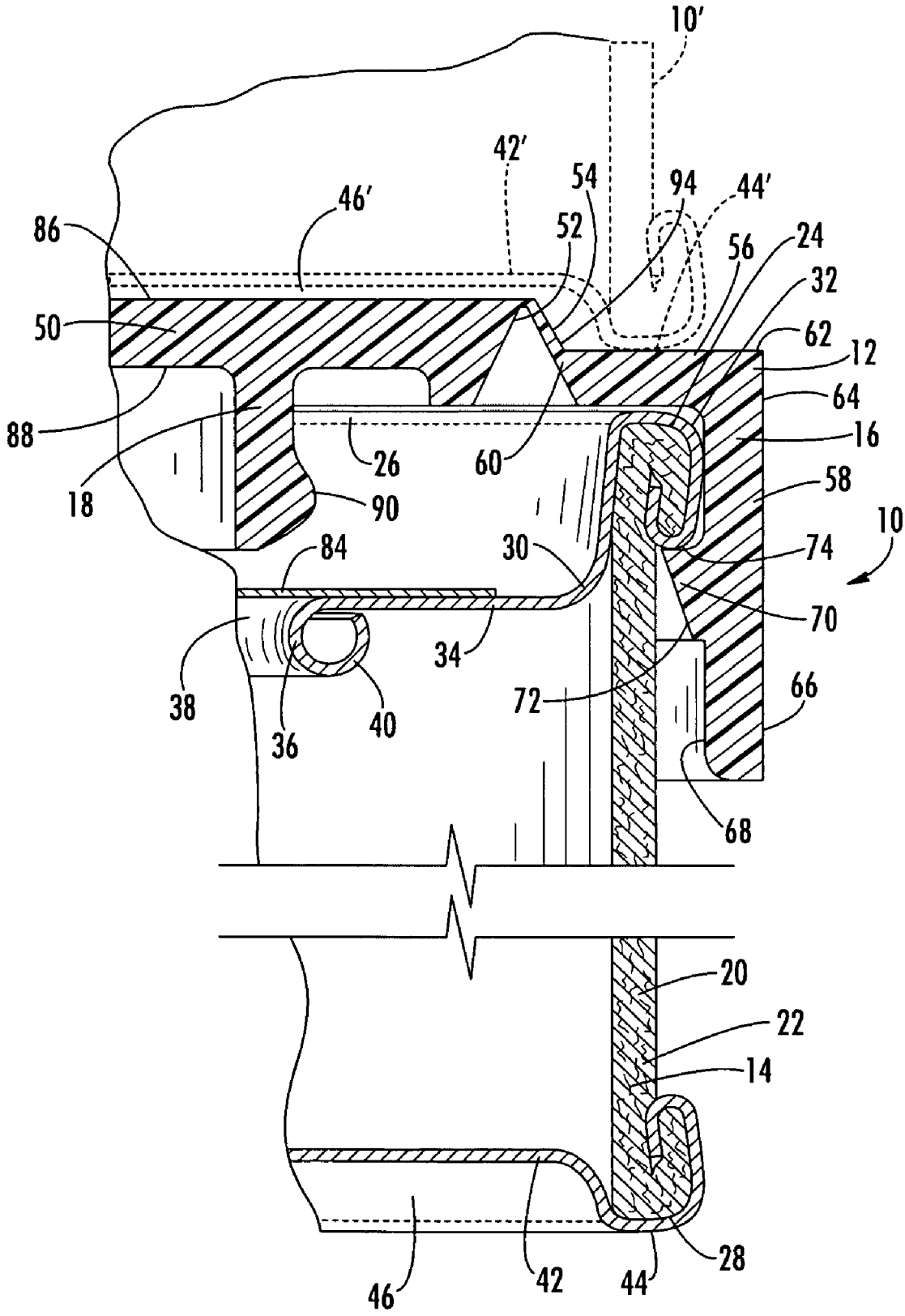
Figure 4:
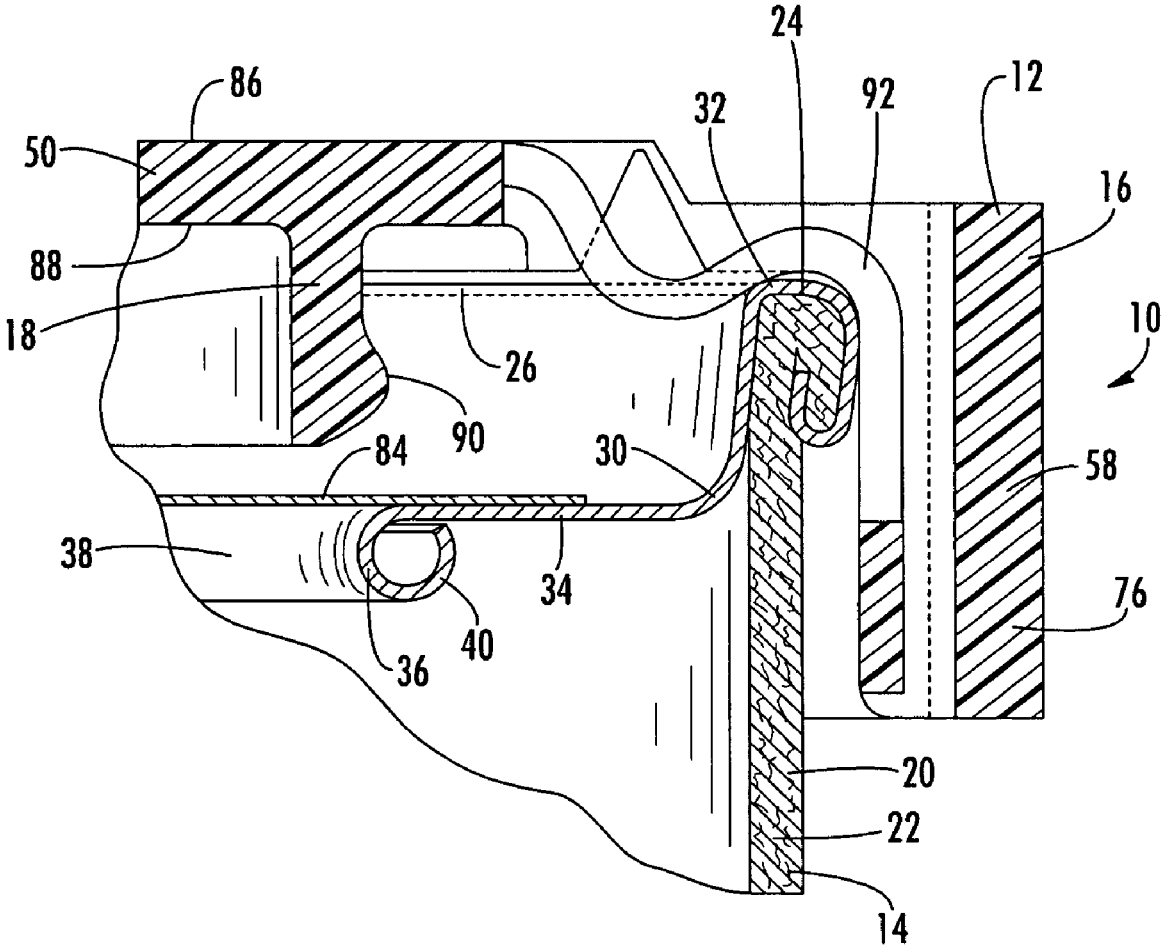
Figure 5:
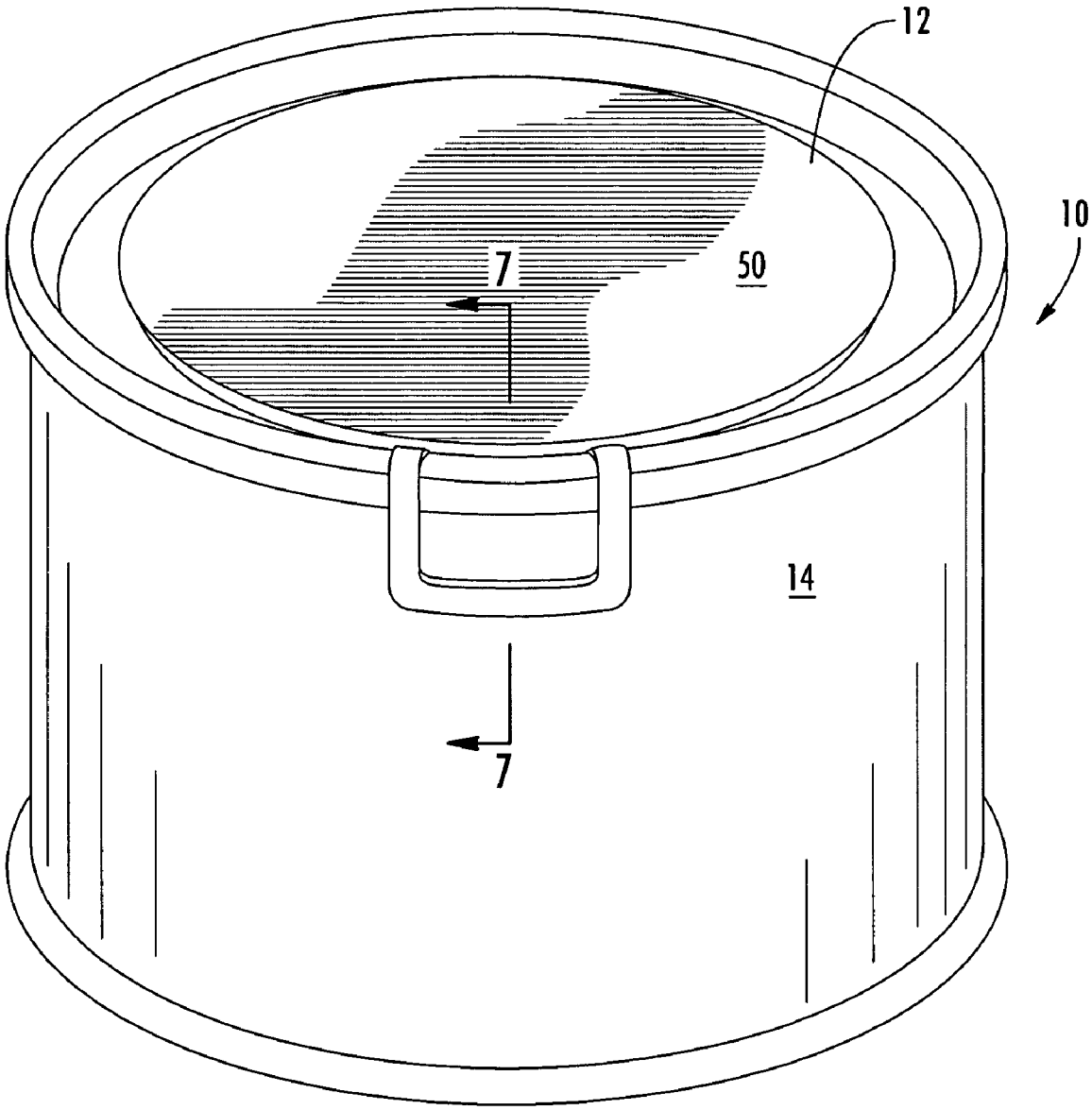
Figure 6:
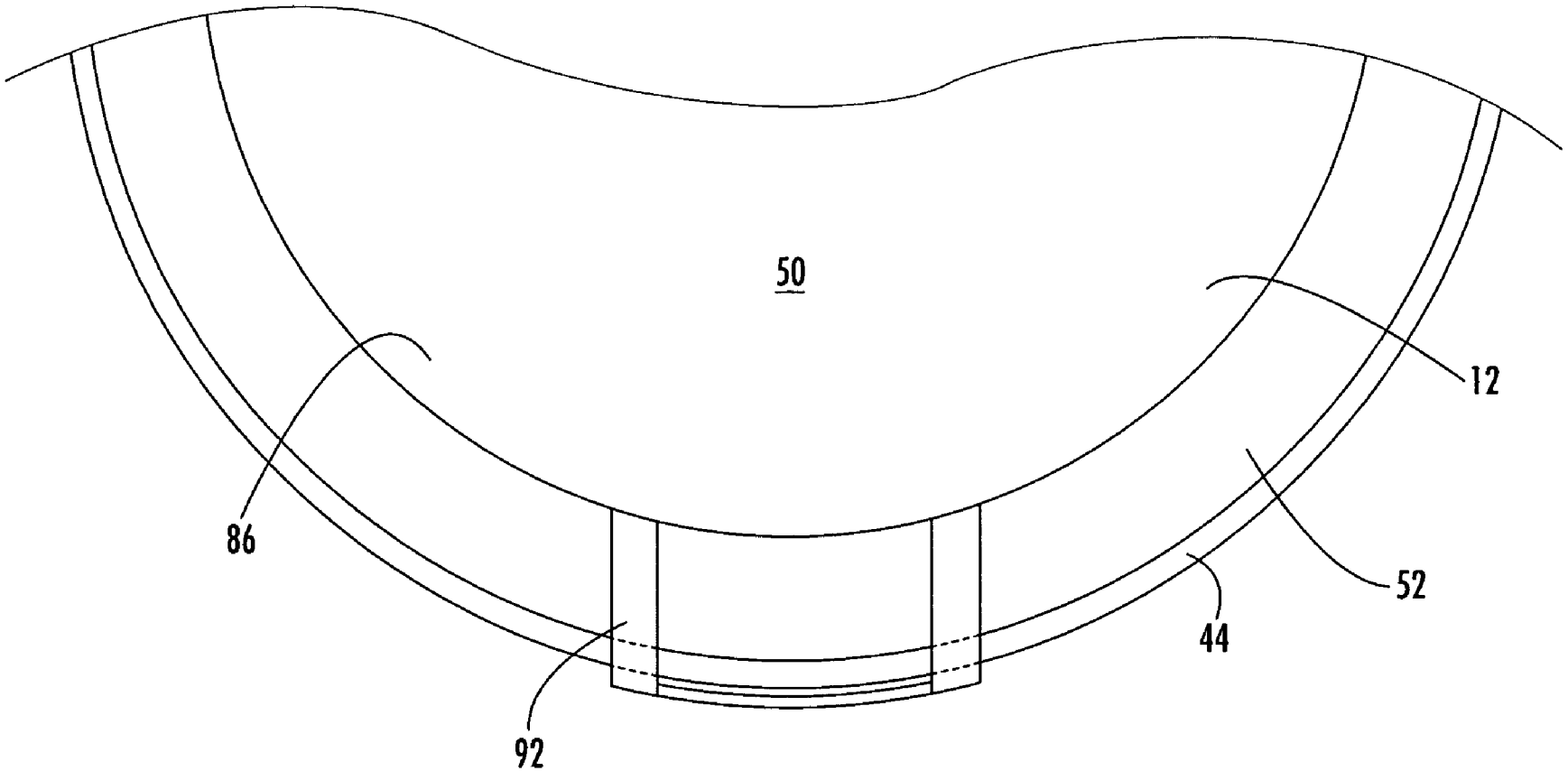
Figure 7:
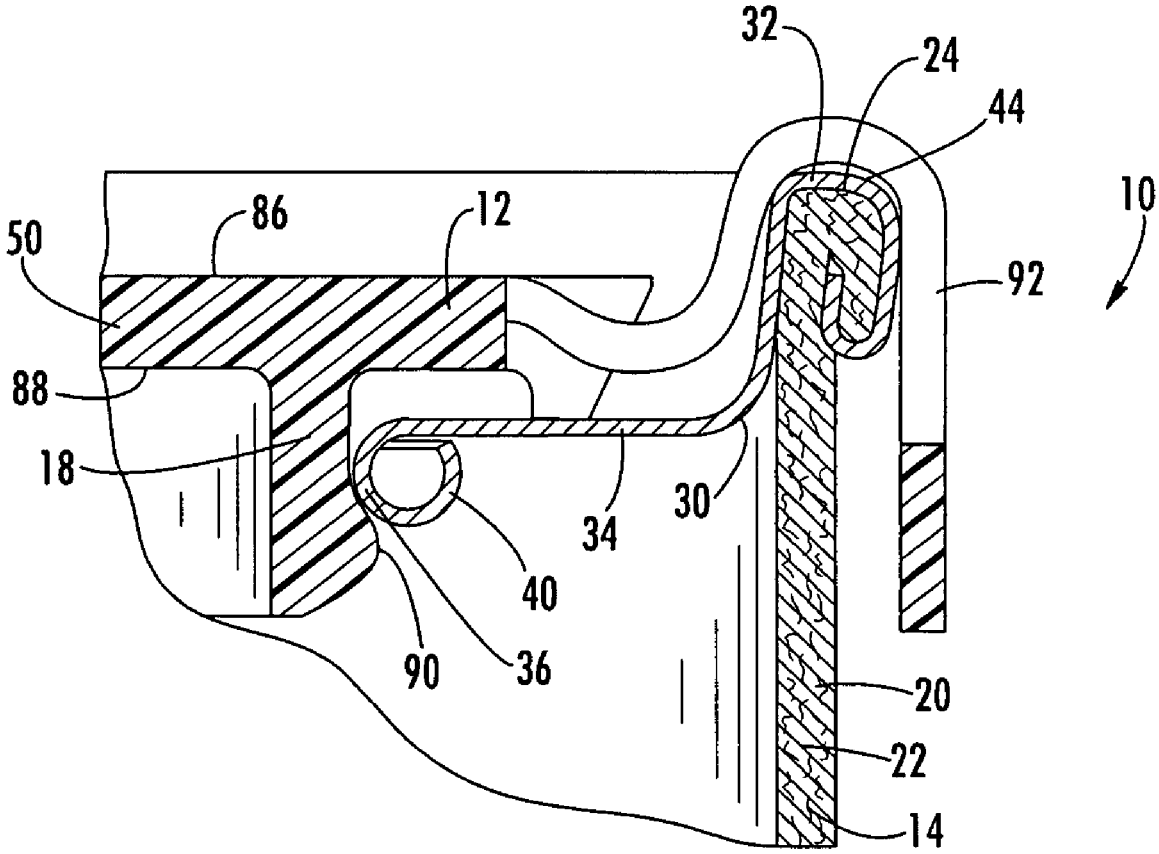

Having thus described the invention in general terms, reference will now be made to the accompanying drawings, which are not necessarily drawn to scale, and wherein:

FIG. 1 is a perspective view of a container and re-closable closure in accordance with one embodiment of the present invention, illustrating a central portion and a tamper-evident band connected to the central portion by a frangible connecting member;

FIG. 2 is a fragmentary top view of the container and re-closable closure of FIG. 1, illustrating the tab portion of the tamper-evident band and the handle portion of the central portion;

FIG. 3 is a schematic, cross-sectional view of the container and re-closable closure of FIG. 1 taken along the line 3-3, illustrating the stacking surface and stacking step of the closure and the recess of the container for receiving the stacking step of another closure;

FIG. 4 is a schematic, cross-sectional view of the container and re-closable closure of FIG. 1 taken along the line 4-4, illustrating the tab portion of the tamper-evident band and the handle portion of the central portion before the tamper-evident band is removed;

FIG. 5 is a perspective view of the container and re-closable closure of FIG. 1, illustrating the central portion fitted into the central opening of the container after the tamper-evident band has been removed;

FIG. 6 is a fragmentary top view of the container and re-closable closure of FIG. 1 after the tamper-evident band has been removed, illustrating the handle portion of the central portion; and FIG. 7 is a schematic, cross-sectional view of the container and re-closable closure of FIG. 1, illustrating the plug portion fitted into the central opening of the container after the tamper-evident band has been removed.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

With reference to FIGS. 1-7, a container and re-closable closure in accordance with one embodiment of the present invention are illustrated. The container system 10 of FIG. 1 includes a re-closable closure 12 that engages the container 14 along an upper rim or top edge of the container before a membrane lid is removed and that is fitted into an opening of the container after the membrane lid is removed. The re-closable closure 12 includes a tamper-evident band 16 that engages the container 14 before the tamper-evident band and membrane lid are each removed when the container is initially opened. The re-closable closure 12 also includes a plug portion 18, as shown in FIG. 3, that is fitted into a central opening of the container 14, as shown in FIG. 7, to re-close the container after the tamper-evident band and membrane lid have been removed. The closure 12 of the illustrated embodiment is circular; however, further embodiments of the present invention may comprise a closure of alternative shapes, such as elliptical or polygonal, to list two non-limiting examples. Similarly, the container 14 of the illustrated embodiment is generally tubular; however, further embodiments of the present invention may comprise a container of alternative shapes. Accordingly, terms such as radial, circumferential, or the like do not limit the present invention to curved closures or containers.

Referring to FIGS. 1 and 3, the container 14 of the container system 10 of one embodiment of the present invention comprises a container body 20 having a body wall 22 that defines a top edge 24 encircling an opening 26 of the container. The body wall 22 is a paperboard material that is spirally wound into a tubular container body 20. The body wall 22 advantageously includes a liner to provide sufficient barrier properties to the container body 20. Further embodiments of the present invention may comprise a body wall of alternative materials, such as metals or polymers to list two non-limiting examples or alternative shapes formed by alternative methods, such as thermoforming or blow molding to list two non-limiting examples. The top edge 24 of the body wall 22 is advantageously rolled radially outward, and similarly, a bottom edge 28 opposite the top edge is advantageously rolled radially outward. Further embodiments of the container system of the present invention may comprise top edges and/or bottom edges of alternative configurations.

The container 14 also comprises an annular ring 30, as shown in FIG. 3. The annular ring 30 is affixed to the container body 20 by crimping; however, the annular ring of further embodiments may be affixed by alternative techniques such as by forming or by adhering, to list two non-limiting examples. The annular ring 30 has a portion seamed to the top edge 24 of the body wall 22 to define an upper rim 32 of the container body 20. The annular ring 30 includes an annular portion 34 that is spaced below the top edge 24 of the body wall 22 and that extends radially inwardly from the body wall. The annular portion 34 defines a generally planar surface and extends in a direction that is generally perpendicular to the body wall 22; however, further embodiments of the present invention may include an annular portion that defines non-planar surfaces or that extends at any angle relative to the body wall. The annular portion 32 defines a radially inner edge 36 surrounding a central opening 38 of the annular ring 30. The radially inner edge 36 of FIG. 3 can comprise a rolled portion 40; however, further embodiments of the present invention may include a radially inner edge of any configuration.

The container 14 further comprises a bottom closure 42 that is affixed to the bottom edge 28 of the body wall 22 in a similar manner as the annular ring 30 is affixed to the top edge 24 of the body wall, as shown in FIG. 3, so that the bottom closure defines a bottom rim 44 of the container body 20. Further embodiments of the present invention may comprise a bottom closure affixed by alternative techniques provided the bottom closure provides sufficient barrier properties for the container body. The bottom closure 42 includes a recessed portion 46 so that the container body 20 defines a recess opposite the top edge of the container body. The recessed portion 46 enables the container 14 to rest on a stacking surface of another re-closable closure of another container system so that the recess receives a stacking step of another re-closable closure, as described more fully below. As illustrated in FIG. 3, a second container system 10' of one embodiment of the present invention is rested on the re-closable closure 12 of the container system 10.

Referring to FIGS. 1-3, the re-closable closure 12 of the container system 10 includes a tamper-evident band 16 that is connected to a central portion 50 of the re-closable closure 12. The central portion 50 has an outer periphery 52 that is surrounded by the tamper-evident band 16 and is connected to the band by a frangible connecting member 54. The frangible connecting member 54 of the illustrated embodiment of the present invention comprises a plurality of tabs that are generally equally spaced along the outer periphery 52 of the central portion 50. An alternative frangible connecting member of a further embodiment of the present invention may comprise a continuous frangible web that generally extends along the entire outer periphery of the central portion. Still further embodiments of the present invention may comprise alternative frangible connecting members.

The tamper-evident band 16 of FIGS. 1-3 comprises an annular portion 56 and a skirt portion 58. The frangible connecting member 54 is connected to a radially inward edge or surface 60 of the annular portion 56. The annular portion 56 also defines an upper surface of the tamper-evident band 16, which defines a stacking surface 62 as discussed more fully below. The skirt portion 58 extends downward from a radially outward edge or surface 64 that is generally opposite the radially inward edge or surface 60. The skirt portion 58 extends downward from the annular portion 56 in a direction generally perpendicular to the upper surface of the band 16. As shown in FIG. 3, the skirt portion 58 defines an outer surface 66 and an inner surface 68 opposed thereto that are generally parallel. The inner surface 68 defines a retaining portion 70 that generally extends circumferentially along the inner surface. The retaining portion 70 illustrated in FIG. 3 comprises a lead-in edge 72 and a retaining edge 74, wherein the lead-in edge is angled to facilitate the initial engagement of the re-closable closure 12 with the container 14 and wherein the retaining edge defines a surface that is generally perpendicular to the inner surface 68 of the skirt portion 58 and extends radially inward approximately the radial depth of the rolled top edge of the body wall 22. The retaining edge 74 is axially located from a bottom surface of the annular portion 56 a distance that is generally equivalent to the axial depth of the rolled top edge, such that the rolled top edge is radially and axially engaged by the tamper-evident band 16. Therefore, the tamper-evident band 16 is structured and arranged to engage the top edge of the container in a fashion that substantially prevents disengagement or detachment of the band from the top edge without severing the band, as described more fully below. Further embodiments of the present invention may comprise alternative shapes or features that are structured and arranged to engage the top edge of the container in a fashion that substantially prevents detachment of the band from the top edge without severing the band.

The tamper-evident band 16 of the re-closable closure 12 of FIGS. 1-4 comprises a tab portion 76 to facilitate removal of the band from the central portion 50 of the closure. The tab portion 76 of the illustrated embodiment of the present invention is generally radially offset from the skirt portion 58 such that the skirt portion does not define a retaining portion 72 along the circumferential length of the tab portion. The tab portion 76 comprises a cantilevered end 78 that is circumferentially opposed to a connected end 80 that is connected to the skirt portion 58. The tab portion 76 may define any circumferential distance between the connected end 80 and the cantilevered end 78 that is sufficient to facilitate removal of the tamper-evident band 16 from the central portion 50. As shown in FIG. 2, the cantilevered end 78 may be joined to the skirt portion 58 with a frangible web 82 to keep the cantilevered end proximate the closure 12 to prevent the cantilevered end from being inadvertently damaged during shipping and handling of the container system. Further embodiments of the present invention may releasably restrain the cantilevered end or may not restrain the cantilevered end at all.

To remove the tamper-evident band 16 from the central portion 50 of the closure 12, a consumer grasps the cantilevered end 78 and pulls the tab portion 76 in a generally radial direction until the frangible connecting member 54 begins breaking or severing so that the band is separated from the central portion. Because the central portion 50 does not directly engage the container 14 while the band 16 is being removed, it is likely that the consumer will have to hold or restrain the central portion once the frangible connecting member 54 has been broken to such an extent that the tamper-evident band no longer engages the container a sufficient amount to keep the closure 12 connected to the container 14. Advantageously, the consumer then holds or restrains the central portion 50 of the closure 12 while pulling the band 16 away from the central portion to completely break the frangible connecting member 54 and completely separate the central portion and band. The tamper-evident band 16 may then be discarded. Further embodiments of the present invention may provide alternative features, devices, or techniques to remove the tamper-evident band from the central portion.

After the re-closable closure 12 has been disengaged from the container, a membrane lid 84 that is sealed to the upper surface of the annular portion 34 of the annular ring 32 will be completely exposed. The re-closable closure 12 is configured so that the central portion 50 is elevated above the membrane lid 84 when the tamper-evident band 16 is attached to the central portion to provide clearance for the membrane lid. The membrane lid 84, shown in FIGS. 3 and 4, advantageously comprises a metal foil, such as aluminum to list one non-limiting example, which provides sufficient oxygen and moisture barrier properties. Membrane lids of further embodiments of the present invention may comprise alternative materials that provide adequate barrier properties. The membrane lid 84 of FIGS. 3 and 4 is advantageously sealed by heat-sealing to the upper surface of the annular portion 34 circumferentially around the central opening 38 so that the product stored within the container 14 is protected from the ingress of gas, moisture, contaminants, and other matter. Further embodiments of the present invention may seal the membrane lid to the container body by alternative techniques.

The membrane lid 84 must be at least partially removed from the container 14 so that the consumer can access the product within the container. The membrane lid 84 advantageously includes a protruding flap or tab portion that can be grasped to initiate removal of the membrane lid. Alternatively, the membrane lid may omit such a flap or tab portion so that the consumer must puncture the membrane lid to begin removing the membrane lid.

To re-close the container 14 so that the remaining product within the container is substantially sealed from gas, moisture, contaminants, and other undesirable matter after the membrane lid 84 has been removed, the central portion 50 of the re-closable closure 12 may be used to re-close and seal the central opening 38 of the container. The central portion 50 comprises a top surface 86 and a bottom surface 88 opposed thereto. The bottom surface 88 defines a plug portion 18 that is configured to fit into the opening of the container. For the illustrated embodiment of FIGS. 5 and 7, the plug portion 18 is configured to fit into the central opening 38 of the container body 20. The plug portion 18 of the illustrated embodiment of the present invention defines a tubular member that includes a radially outwardly protruding bead 90. The tubular member of the plug portion 18 advantageously defines an outer diameter that is equal to or slightly greater than the diameter of the central opening 38, and the radially outwardly protruding bead 90 defines a maximum outer diameter that is greater than the diameter of the central opening. The relative diameters of the plug portion 18 may be varied based upon the material properties and thickness of the tubular member and bead so long as the bead is sized such that a minimal amount of force is required to fit the plug portion into, or remove the plug from, the central opening and so that the fitted plug portion provides a seal to substantially prevent the ingress of gas and moisture. The bead 90 of the illustrated embodiment of the present invention advantageously extends along the entire circumference of the plug portion 18; however, further embodiments of the present invention may include a bead that comprises one or more discrete radially outwardly protruding bead portions that are circumferentially spaced apart. Still further embodiments of the present invention may include alternative shapes or devices to retain the plug portion in the opening of the container.

Referring to FIG. 3, the plug portion 18 defines a distal end opposite the bottom surface 88 of the central portion 50. The distal end of the plug portion 18 is advantageously spaced a first axial distance from the bottom surface 88 of the central portion 50 to the distal end of the plug portion. As shown in FIG. 3, the radially outwardly protruding bead 90 is located at an axial distance from the bottom surface 88 of the central portion 50 that is less than the first axial distance; however, further embodiments of the present invention may define an axial distance of the bead that is equivalent to the first axial distance. For the illustrated embodiment of the present invention, the axial distance of the distal end of the plug portion 18 is advantageously correlated to an axial distance of the retaining portion 70 such that the plug portion 12 does not contact the membrane lid 84 because it does not extend substantially beyond the retaining portion. Advantageously, the retaining portion 70 is spaced a second axial distance from the bottom surface 88 of the central portion 50 to the retaining edge 74; however, further embodiments of the present invention may define the second axial distance to any portion of the retaining portion. As shown in FIG. 3, the first axial distance of the plug portion 18 is not substantially greater than the second axial distance of the retaining portion 70, such that the plug portion provides clearance for the membrane lid of the container 14 to which the closure 12 is engaged. Further embodiments of the present invention may space or correlate the axial distance of the plug portion in alternative manners to provide clearance for a membrane lid of the container.

As shown in FIGS. 5-7, the central portion 50 of the re-closable closure 12 includes a handle portion 92 to facilitate handling of the central portion, particularly when the central portion is being removed from the container 14. The handle portion 92 of the illustrated embodiment of the present invention extends radially outward from the outer periphery 52 of the central portion 50 and then extends axially downward along the outside of the container body 20. Advantageously, the handle portion 92 is configured to conform to the contours of the container 14, particularly the contours of the annular ring 32, both before and after the tamper-evident band 16 has been removed. The handle portion 92 advantageously comprises a loop to facilitate grasping by the consumer and is made of a material that can withstand the forces required to remove the plug portion 18 from the central opening 38. Further embodiments of the present invention may comprise handle portions with alternative shapes, sizes, or materials that enable a consumer to conveniently remove the plug portion of the central portion from the opening of the container. The plug portion and handle portion are configured to withstand repeated fittings and unfittings of the plug portion with the opening of the container.

Because the central portion 50 seals the container 14 to prevent the ingress of gas, moisture, contaminants, and other matter into the previously opened container, the re-closable closure 12, and particularly the central portion, comprises a polymer material that substantially prevents the passage of gases, such as oxygen, through the central portion. One non-limiting example of a polymer material is ethylene vinyl alcohol copolymer material; however, further embodiments of the present invention may be made of alternative polymer materials or non-polymer materials. The re-closable closure 12 of the illustrated embodiment of the present invention advantageously can be manufactured using an injection mold process, wherein the entire closure is made of the same material. Re-closable closures of further embodiments of the present invention may be manufactured using alternative forming techniques or may be manufactured so that the various portions, such as the tamper-evident band, plug portion, or central portion are made of different materials or incorporate additional materials.

Referring again to FIG. 3, illustrating the container system 10 before the tamper-evident band 16 has been removed from the re-closable closure 12, the closure of the present invention enables another container system to be stacked onto the top of the closure. In particular, the upper surface of the tamper-evident band 16 defines a stacking surface 62 upon which the bottom rim 44' of the container body 20 may be positioned to support the other container system 10'. The tamper-evident band 16 of the closure 12 of the container system 10 is advantageously dimensioned to provide a stacking surface 62 of sufficient radial width for the bottom rim 44 of the container 14 to be stacked upon securely.

The top surface 86 of the central portion 50 is parallel to and offset above the stacking surface 62 of the tamper-evident band 16, as shown in FIG. 3. Accordingly, the top surface 86 of the central portion 50, along with the frangible connecting member 54 and the tamper-evident band 16, defines a stacking step 94. The stacking step 94 comprises the portion of the re-closable closure 12 located between the parallel stacking surface 62 and top surface 86, such that the staking step may include portions of the tamper-evident band 16, the frangible connecting member 54, and/or the central portion 50. Further embodiments of the present invention may define a stacking step of any combination of the central portion, frangible connecting member, and/or tamper-evident band. The stacking step 94 is proximate stacking surface 62 so that the stacking step engages the recessed portion 46' of the bottom closure 42' of a container system 10' stacked onto the original container system 10. Accordingly, the stacking step 94 prevents lateral movement of the stacked container system 10' so that the stacked container system is less likely to fall off the original container system if a lateral force or impact is exerted on the stacked container system. Advantageously, the recessed portion 46 of the container body 20 is sized to receive the stacking step 94 along the entire circumferential distance of the stacking step 94 and may also provide an amount of clearance so that the container systems can be easily stacked. Further embodiments of the present invention may provide alternative shapes or sizes of stacking steps and recessed portions to prevent lateral movement of a stacked container system.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container and re-closable closure, comprising:

a container body having a body wall that defines a top edge encircling an opening of the container body;

an annular ring affixed to the container body and having an annular portion spaced below the top edge of the body wall and extending radially inwardly from the body wall, the annular portion defining a radially inner edge surrounding a central opening of the ring, the ring having a portion seamed to the top edge of the body wall to define an upper rim of the container body;

a membrane lid sealed to an upper surface of the annular portion of the ring; and a re-closable closure engaged with the upper rim of the container body, the closure comprising:

a generally annular tamper-evident band structured and arranged to engage the upper rim of the container body in a fashion substantially preventing detachment of the band from the upper rim without severing the band; and a central portion surrounded by the tamper-evident band and having an outer periphery connected to the band by a frangible connecting member, the central portion spaced above the membrane lid as long as the band remains connected to the central portion, breakage of the frangible connecting member permitting the band to be removed from the central portion, the central portion defining a plug portion configured to fit into the central opening of the ring after removal of the membrane lid so as to re-close the container.

2. A container and re-closable closure according to claim 1 wherein the tamper-evident band comprises a tab portion to facilitate removal of the tamper-evident band from the central portion.

3. A container and re-closable closure according to claim 1 wherein the frangible connecting member of the tamper-evident band comprises a plurality of tabs.

4. A container and re-closable closure according to claim 1 wherein the central portion of the closure comprises a handle portion extending generally radially outward from the outer periphery of the central portion.

5. A container and re-closable closure according to claim 1 wherein the plug portion of the closure comprises an outwardly protruding bead that passes through the central opening of the ring when the closure re-closes the container.

6. A container and re-closable closure according to claim 1 wherein the membrane Lid comprises a metal foil.

7. A container and re-closable closure, comprising:

a container body having a body wall that defines a top edge encircling an opening of the container body;

an annular ring affixed to the container body and having an annular portion spaced below the top edge of the body wall and extending radially inwardly from the body wall, the annular portion defining a radially inner edge surrounding a central opening of the ring, the ring having a portion seamed to the top edge of the body wall to define an upper rim of the container body;

a membrane lid sealed to an upper surface of the annular portion of the ring; and a re-closable closure engaged with the upper rim of the container body, the closure comprising:

a generally annular tamper-evident band structured and arranged to engage the upper rim of the container body in a fashion substantially preventing detachment of the band from the upper rim without severing the band, the tamper-evident band defining an upper surface; and a central portion surrounded by the tamper-evident band and having an outer periphery connected to the band by a frangible connecting member, the central portion spaced above the membrane lid as long as the band remains connected to the central portion, breakage of the frangible connecting member permitting the band to be removed from the central portion, the central portion defining a plug portion configured to fit into the central opening of the ring after removal of the membrane lid so as to re-close the container;

wherein the upper surface of the tamper-evident band defines a stacking surface that is parallel to and offset below the top surface of the central portion such that the closure defines a stacking step.

8. A container and re-closable closure according to claim 7 wherein the tamper-evident band comprises a tab portion to facilitate removal of the tamper-evident band from the central portion.

9. A container and re-closable closure according to claim 7 wherein the frangible connecting member of the tamper-evident band comprises a plurality of tabs.

10. A container and re-closable closure according to claim 7 wherein the frangible connecting member of the tamper-evident band comprises a frangible web.

11. A container and re-closable closure according to claim 7 wherein the central portion of the closure comprises a handle portion extending generally radially outward from the outer periphery of the central portion.

12. A container and re-closable closure according to claim 7 wherein the body wall of the container body defines a recess opposite the top edge such that the container is configured to rest on a stacking surface of another re-closable closure so that the recess receives the stacking step of the another re-closable closure.

13. A container and re-closable closure according to claim 7 wherein the membrane lid comprises a metal foil.

* * * * *